United States Patent [19]

Wickett

[11] 4,223,574

[45] Sep. 23, 1980

[54] AXEL RETRACTER

[76] Inventor: Richard S. Wickett, 703 E. Second, Indianola, Iowa 50125

[21] Appl. No.: 893,670

[22] Filed: Apr. 5, 1978

[51] Int. Cl.[3] ..... B25B 27/00

[52] U.S. Cl. ..... 81/3 R

[58] Field of Search ..... 81/3 R, 1 R

[56] References Cited

U.S. PATENT DOCUMENTS

| | | | |
|---|---|---|---|
| 4,050,334 | 9/1977 | Davis, Jr. | 81/3 R X |
| 4,096,617 | 6/1978 | Ritter, Jr. | 81/3 R X |
| 4,113,192 | 9/1978 | Osanai | 81/3 R X |

*Primary Examiner*—James G. Smith

[57] ABSTRACT

This invention will provide a simple and expedient means of removing the remains of a broken axle from the housing of a axle driven vehicle. It is a one piece tool constructed of spring steel, therefore allowing it to depress to 180° when inserted under broken axle, then retain it's shape causing friction between Axle Retracter and broken axle, permitting broken axle to be removed from it's housing with Axle Retracter.

4 Claims, 7 Drawing Figures

AXEL RETRACTER

BACKGROUND OF THE INVENTION

This invention relates to axle driven vehicles which require a drive shaft, or axle. On occasion, the axle may break due to stress. When this happens the broken axle must be removed before a serviceable axle can be installed. The outermost end of the axle may be withdrawn with one of various means, such as a wheel puller, but the innermost end of the axle remains inside the axle housing. This invention will make it possible to withdraw the innermost part of a broken axle from it's housing, and eliminate the need for disassembly of the vehicle to attain it's removal.

DETAILED DESCRIPTION

Analysis of spring steel stock is as follows:

Carbon 0.90–1.03—tempered at 1400° to 1500° F.

Magnesium 0.03–0.50—Rockwell no. 66 when quenched

Phosphorous 0.040—Gauge 16

Sulphur 0.050

Figure 1:
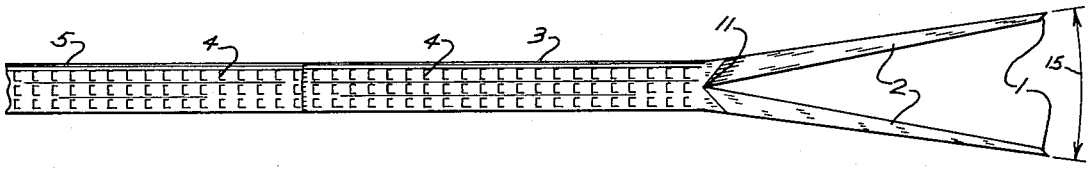
FIG. 1, of sheet 1 of 3: Shows partial top view of Axle Retracter.
Figure 7:
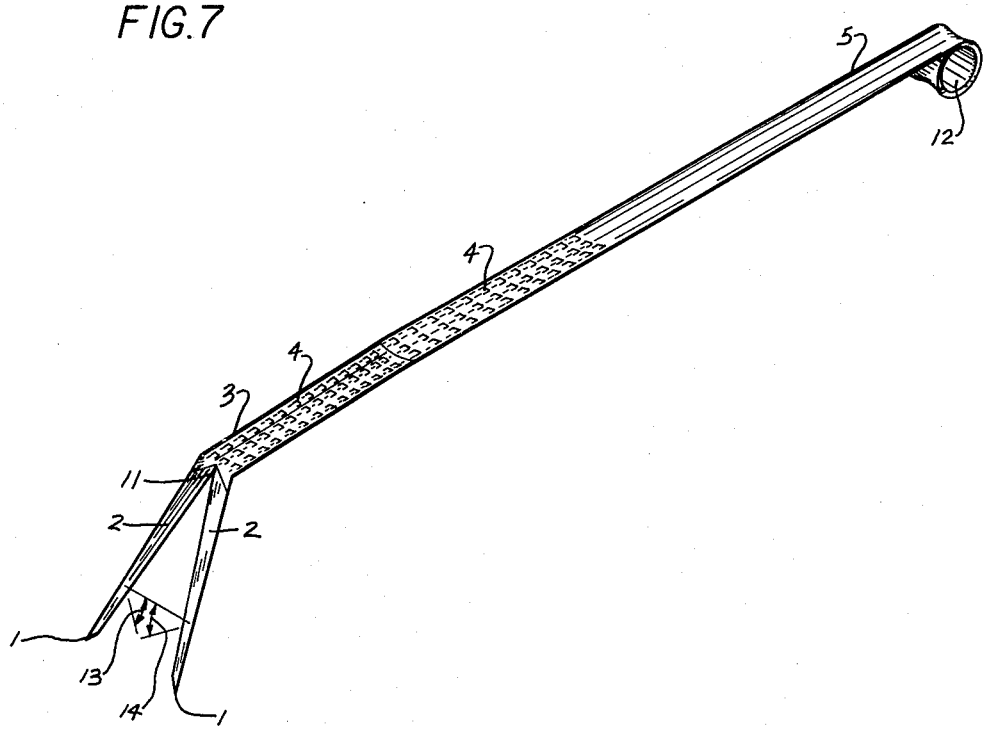
FIG. 7, of sheet 3 of 3: Shows Axle Retracter in perspective.

FIG. 1, top view sheet 1 of 3, shows a partial top view of Axle Retracter in actual size. The very ends of prongs 2 which are main springs, are seperated 15 a distance not to exceed diameter of axle, 8 (which, for descriptive purposes will be $1\frac{3}{8}''$,) and must be filed to insure smooth installation. Main springs 2 are twisted inwards to an angle of 45° clock-wise 13 and 45° counter-clockwise 14 when main spring steel prongs 2 are viewed, as in FIG. 7. The main springs are twisted to facillitate insertion of Axle Retracter under broken axle 8.

Main springs 2 are $\frac{1}{8}''$ in width at the ends, 1 and taper to $\frac{1}{4}''$ width immediately adjacent to the handle 11. Handle of Axle Retracter 3 and 5, is bent to a concave form, when viewed from above, to conform to shape of axle, and for greater stability. Axle Retracter may be formed of 16 gauge steel stock.

Figure 2:
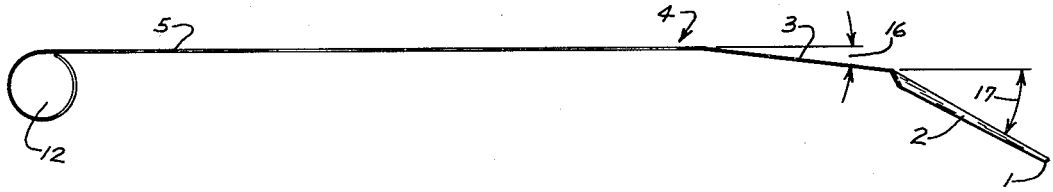
FIG. 2, of sheet 1 of 3: Shows side view of Axle Retracter.

FIG. 2, side view sheet 1 of 3, handle of Axle Retracter 3 and 5, is approximately $\frac{1}{2}''$ in width. This view shows Axle Retracter in it's entirety, in horizontal position. Prongs 2 are bent downward 2" from horizontal 17 forming an angle of 30°. Approximately 4" of the handle 3 immediately adjacent to the prongs are bent an additional $\frac{1}{2}''$ downward from horizontal 16 forming an angle of 7°-11'. Sharp metal teeth 4 are cut into the handle 3 and 5 to create added friction between Axle Retracter and broken axle 8.

Finger hole 12 is formed on end of handle of Axle Retracter by rotating the end of Axle Retracter opposite main springs 2 into 360° turn having a diameter of approximately $1\frac{1}{2}''$.

Figure 3:
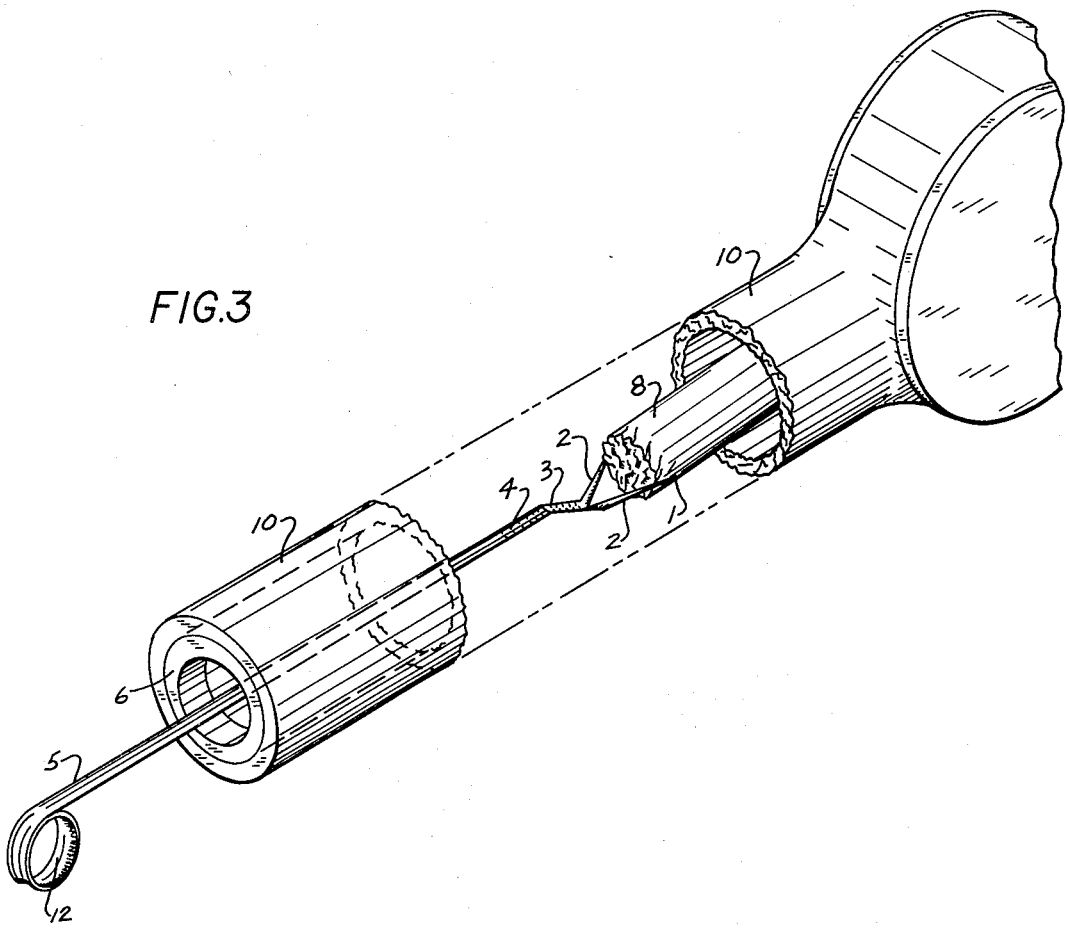
FIG. 3, of sheet 1 of 3: Shows perspective cutaway of Axle Retracter being inserted into axle housing under broken axle.

FIG. 3, perspective cutaway view sheet 1 of 3, shows Axle Retracter being installed in axle housing 10 and under broken axle 8.

Figure 4:
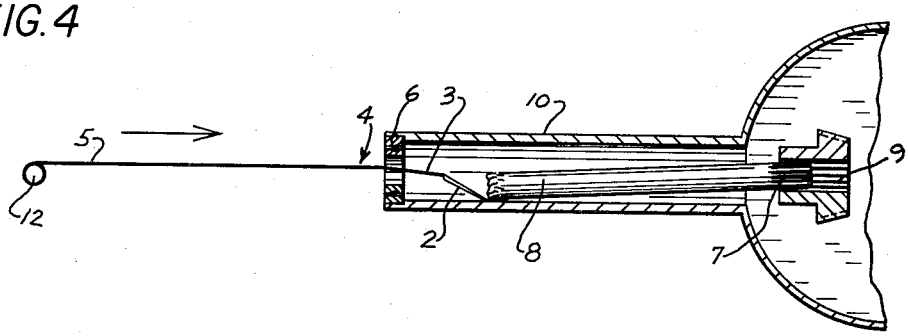
FIGS. 4, 5 and 6, of sheet 2 of 3: Shows detailed views of operation of Axle Retracter, which are explained in the description.

FIG. 4, side view sheet 2 of 3, shows broken axle 8 inside of axle housing 10. Axle 8 drops down when broken causing considerable friction between spline 7 on axle and rear end spline 9, which engage each other. Handle of Axle Retracter 5 is now in position to be pushed in direction of arrow under broken axle 8, causing springs 3 and 2 to depress.

Figure 5:
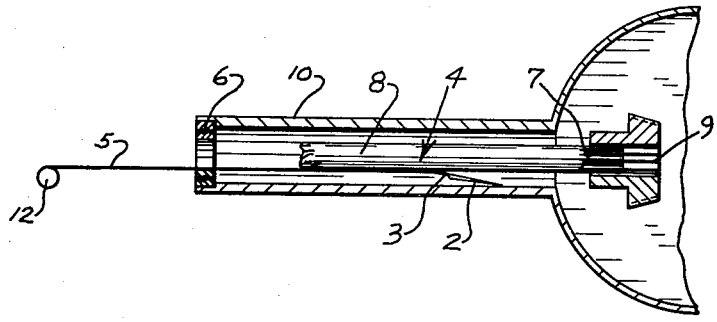

FIG. 5, side view sheet 2 of 3, shows Axle Retracter inserted under broken axle 8. Springs 2 and 3 have returned to near normal level, therefore relieving friction between spline 7 on axle and spline 9 on rear end assembley. Now, because of weight of axle 8 and upward pressure of springs 2 and 3 on Axle Retracter less friction is created between spline 7 on axle, and spline 9 on rear end assembley. Now broken axle 8 is ready to be retracted.

Figure 6:
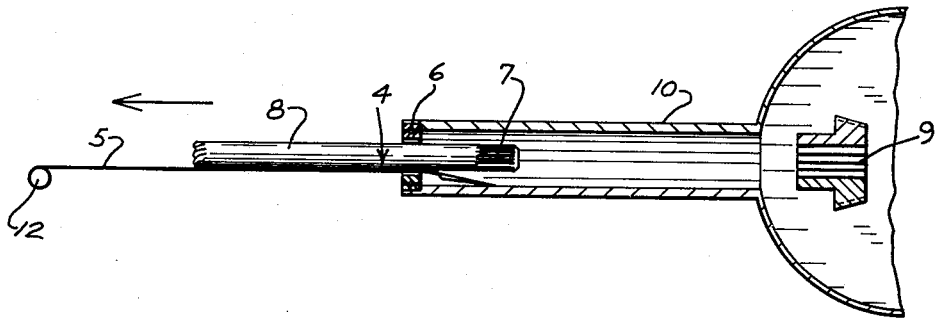

FIG. 6, side view sheet 2 of 3, as Axle Retracter is pulled in direction of arrow spline 7 on axle 8 disengages from spline 9 on rear end assembley, and broken axle 8 slides out of axle housing 10 thru wheel bearing 6 with Axle Retracter. As soon as the end of broken axle 8 emerges from wheel bearing 6 far enough to get hold of it with one's hand, Axle Retracter must be removed before broken axle 8, because of restricted space between spline 7 of axle and wheel bearing 6. If for some reason, excessive resistance is encountered in removing broken axle 8, two Axle Retracters may be utilized. Placing one on bottom, and one on top of broken axle 8, applying same method of insertion, and causing greater friction between broken axle 8 and Axle Retracter.

Since obvious changes may be made in the specific embodiment of the invention described herein, such modifications being within the spirit and scope of the invention claimed, it is indicated that all matter contained herein is intended as illustrative and not as limiting in scope.

The embodiments of the invention in which an exclusive property or privilege is claimed are as follows:

1. A tool for use in the removal of a broken axle from the housing of a axle driven vehicle, such tool comprising spring steel construction with prongs on one end, which serve as main springs, said prongs not to be farther apart at their widest point then diameter of axle, and twisted inward, clockwise and counter-clockwise to angles of 45° to facillitate manipulation of tool under broken axle, and bent downward at a 30° angle.

2. Tool in claim 1, having approximately 4" of the handle immediately adjacent to the prongs bent downward and additional 7°-11' to insure appropriate amount of friction between tool and axle to accomplish removal of broken axle.

3. Tool in claim 1, having sharp metal teeth cut into top of tool to increase friction between tool and broken axle, therefore insuring removal of broken axle with tool.

4. Tool in claim 1, being 6" longer than total length of axle and bent to concave form to conform to shape of axle and insure greater stability of tool handle, said handle having a finger hole to facillitate insertion and removal of tool.

* * * * *